United States Patent [19]

Schwartz

[11] Patent Number: 4,811,436

[45] Date of Patent: Mar. 14, 1989

[54] CHILD CRIB WITH DISPLACEABLE AND STORABLE SIDE GATE

[75] Inventor: Leo Schwartz, Montreal, Canada

[73] Assignee: Dorel Industries Inc., Montreal, Canada

[21] Appl. No.: 140,669

[22] Filed: Jan. 4, 1988

[51] Int. Cl.[4] ..... A47D 7/00

[52] U.S. Cl. ..... 5/93 R; 5/100; 5/285; 5/428

[58] Field of Search ..... 5/93 R, 100, 425, 428, 5/429, 430, 280, 285

[56] References Cited

U.S. PATENT DOCUMENTS

| | | | |
|---|---|---|---|
| 850,845 | 4/1907 | Muir | 5/100 |
| 3,193,849 | 7/1965 | Landry | 5/100 |
| 3,403,412 | 10/1968 | Gottfried et al. | 5/100 |
| 3,862,455 | 1/1975 | Turski | 5/100 |
| 4,108,517 | 8/1978 | Tomalinas, Jr. et al. | 312/297 |
| 4,450,597 | 5/1984 | Hull | 5/285 X |
| 4,680,820 | 7/1987 | Bittner | 5/451 |
| 4,715,074 | 12/1987 | Wallace et al. | 5/100 X |

FOREIGN PATENT DOCUMENTS

| | | | |
|---|---|---|---|
| 0021907 | of 1901 | United Kingdom | 5/100 |

*Primary Examiner*—Ramon O. Ramirez

*Attorney, Agent, or Firm*—Burns, Doane, Swecker & Mathis

[57] ABSTRACT

A child crib comprising a head and a foot frame. A mattress is supported elevated between the frames. Each of the frames has opposed vertical side edge members. A gate is secured to one side of the mattress between a common one of the vertical side edge members of the head and foot frame, and extends above the mattress. The other common ones of the vertical side edge members each have a first straight elongated guide channel section extending in a predetermined length thereof and communicating at a lower end thereof with a further guide channel section extending under the mattress. A displaceable gate having at least two spaced apart guide member in opposed side edges thereof is also provided with the guide members engaging the guide channels whereby the displaceable gate is displaceable from a position of use between the other common ones of the vertical side edge members to a storage position under the mattress.

17 Claims, 4 Drawing Sheets

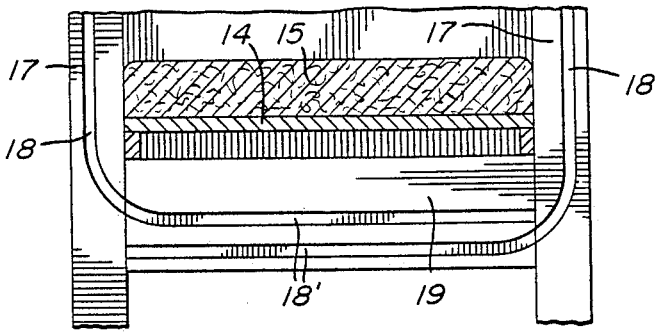
FIG. 11
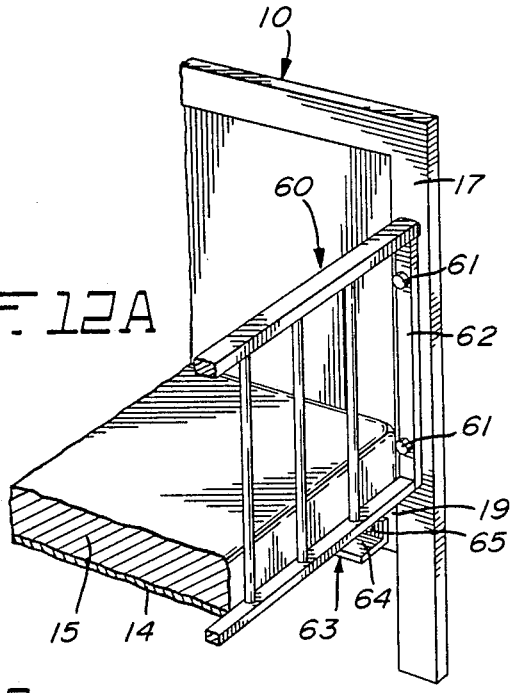
FIG. 12A
FIG. 12B
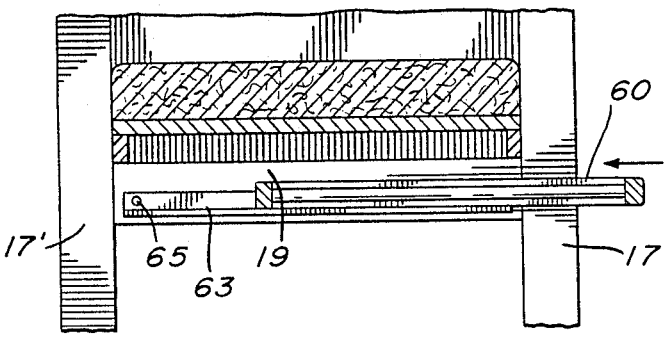

CHILD CRIB WITH DISPLACEABLE AND STORABLE SIDE GATE

BACKGROUND OF INVENTION

1. Field of Invention

The present invention relates to an improved child crib and wherein at least one of the opposed side gates of the crib is slidingly guided from a position of use where it spans a head and foot frame above the mattress to a storage position where it is located under the mattress.

2. Description of Prior Art

It is known to provide cribs wherein one of the gates of the crib may be lowered in its vertical plane to provide better access to the mattress for changing sheets or for access to the child occupying the mattress. However, these side gates can only be lowered a minimal amount as the bottom end of the gate will engage the floor area. Accordingly, the lowering of the gate is restricted to a minimal distance. A disadvantage of side gates is that the person wishing access to the mattress of the crib must bend over the gate and reach down to the mattress area. When a person reaches down over the gate it places a strain on the person's back which could be harmful. Also, these gates do not provide easy access to the child, as the child must be grasped and lifted with the arms extended. Injury could also be caused to the child if he is improperly lifted due to this improper posture. Another disadvantage of these gates is that it makes it difficult for a person to change the bed sheets or to remove the mattress from the crib. Still further, the gates which are normally slidable vertically downwards are connected by a latch mechanism guided on a rod and provide loose connection to the crib. Thus, when a young child is standing on the mattress and holding the gate, he can rattle the gate to make noise. Also, the child may accidently disconnect the latch causing injury to his fingers and possibly falling off the crib over the gate.

SUMMARY OF INVENTION

It is a feature of the present invention to provide a child crib having an improved displaceable gate which substantially overcomes all of the above-mentioned disadvantages of the prior art.

Another feature of the present invention is to provide a displaceable gate which is displaceable from a position of use, above the mattress, to a storage position under the mattress whereby to completely clear the area above the mattress.

Another feature of the present invention is to provide a child crib having a displaceable gate which is guided to a storage position under the mattress by inner guide channels and which remains in engagement with the crib when in its position of use or storage.

Another feature of the present invention is to provide a child crib having a displaceable gate to permit a grown child to climb on and out of the mattress of the crib by permitting the mattress to be secured in a lowered part of the crib with the displaceable gate thereunder.

Another feature of the present invention is to provide a child crib having a displaceable gate with locking means adjacent the top end of the gate to immovably secure the displaceable gate in its position of use.

According to the above features, from a broad aspect, the present invention provides a child crib having a head and a foot frame. A mattress is supported elevated between the head and foot frame. The head and foot frames each have opposed vertical side edges. A gate is secured to each side of the mattress between common ones of the vertical side edges. The improvement comprises guide channel means disposed in the vertical side edges and under the mattress for guiding displacement of at least one of the gates from a position of use between the vertical side edges to a storage position under the mattress.

According to a still further broad aspect of the present invention there is provided a child crib comprising a head and foot frame. A mattress is supported elevated between these frames. The frames each have opposed vertical side edges. A gate is secured between opposed sides of the mattress between a common one of said vertical side edges of said head and foot frames, and is removably secured between the vertical side edges by detachable connecting means. Support means is provided under the mattress for supporting the removable gate in a storage position when disengaged from its associated vertical side edges.

BRIEF DESCRIPTION OF DRAWINGS

A preferred embodiment of the present invention will now be described with reference to the examples thereof as illustrated in the accompanying drawings in which:

FIG. 11 is a fragmented section view showing a crib having two displaceable gates;

FIG. 12A is a perspective view illustrating the basic principle of the present invention wherein the side gate is a detachable side gate; and FIG. 12B is a fragmented section view showing the detachable gate being stored under the mattress between support flanges.

DESCRIPTION OF PREFERRED EMBODIMENTS

Figure 1:
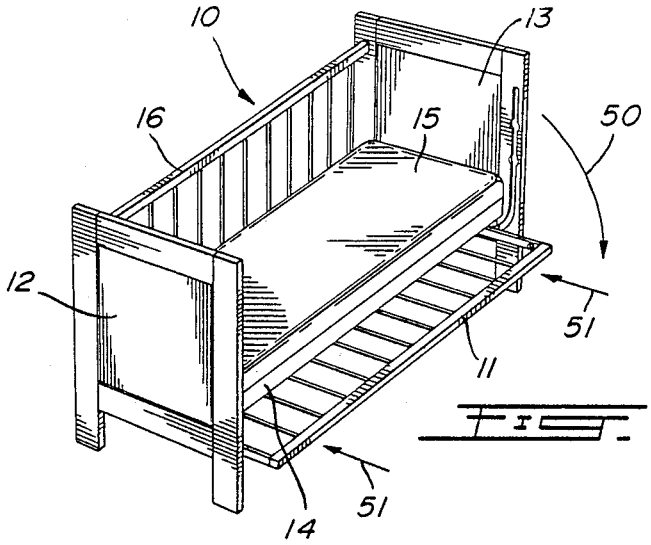
FIG. 1 is a perspective view of the child crib of the present invention showing the displaceable gate.

Referring now to the drawings, and more particularly to FIG. 1, there is shown generally at 10 a child crib provided with the displaceable gate 11 of the present invention. The crib 10 comprises essentially a head frame 12, a foot frame 13, a mattress support frame 14, and a mattress 15 supported on the frame 14. A stationary or otherwise supported gate 16 is also provided on the side of the mattress 15 opposed to the displaceable gate 11.

Figure 2:
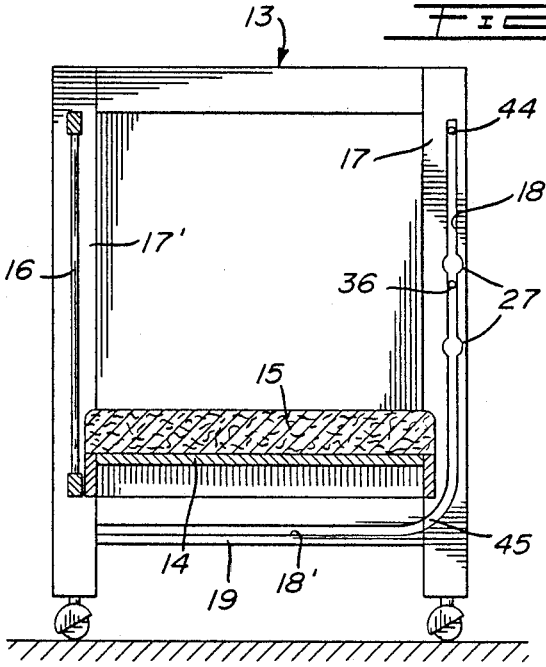
FIG. 2 is a plan view of the inside surface of the head frame of the crib.
Figure 3:
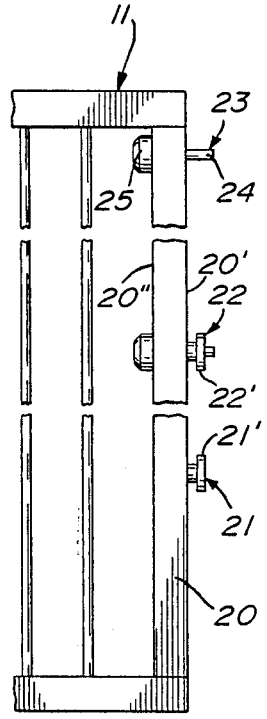
FIG. 3 is a fragmented side end view of the displaceable gate.
Figure 4:
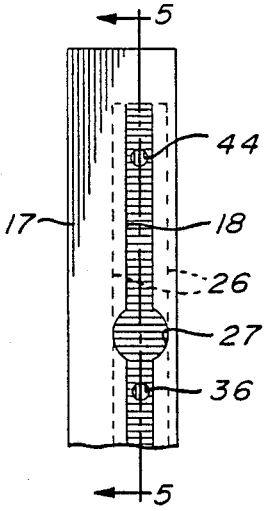
FIG. 4 is a fragmented plan view of the vertical side member.
Figure 5:
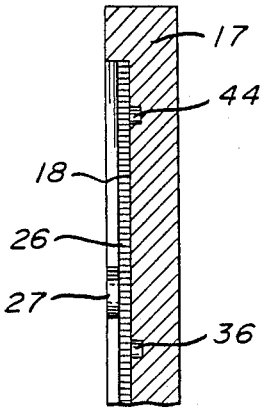
FIG. 5 is a section view through section line V—V of FIG. 4.

Referring now additionally to FIGS. 2 to 9, there will be described the construction operation of the displaceable gate 11 of the present invention. As shown in FIG. 2, the head and foot frames are each provided in opposed vertical side edges thereof with vertical supports, wooden posts or members 17 and 17', with the stationary gate 16 secured between common ones of the vertical side members 17'. The other vertical member 17 is provided with an elongated guide channel or guide slot 18 which extends in a first straight section along a predetermined length of the vertical side member 17. This first section communicates at a lower end thereof with a further straight section 18' disposed in a cross piece 19 disposed under the mattress support frame 14. The second section 18' is also sufficiently long to accommodate the complete height of the displaceable gate 11 under the mattress 15. In its position of use, the gate 11 is disposed substantially parallel to the stationary gate 16 and at the same height thereof. In its storage position the displaceable gate is located under the mattress.

As shown in FIGS. 3, 6, 7 and 8, the displaceable gate is also provided with engaging means and opposed side edges or outer side walls of edge posts 20 of the gate 11. This engaging means is constituted by at least two spaced apart guide members, herein a lower guide member 21, and an intermediate guide member 22. A lock member 23 is disposed adjacent a top end portion of the edge post 20 and is provided with a spring-biased lock pin 24 which extends out of the outer edge 20' of the edge post 20. A retractable finger-engaging head 25 is secured to the lock pin 24 and disposed adjacent an inner edge 20'' of the post 20 for retracting the lock pin 24 entirely within the post. The lower and intermediate guide members 21 and 22 are provided with shoulder portions 21' and 22' for engagement in an undercut channel 26 provided on opposed elongated side edges of a guide slot 18 and for sliding retention therein. In order to position the shoulder portions 21' and 22' within the slots 18, there is provided two spaced apart entrance openings 27 (see FIG. 2) which are spaced apart the same distance as the guide members 21 and 22.

Figure 8:
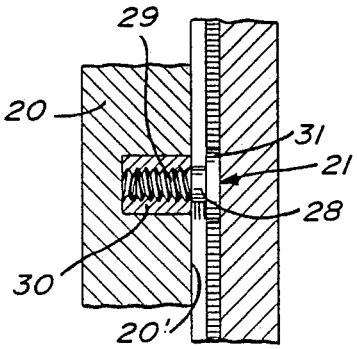
FIG. 8 is a fragmented section view showing the construction of the lower guide member.

As shown in FIG. 8, the lower guide member is constituted by a guide rod 28 extending outwardly of the outer side edge 20' and secured within the edge post 20 by means of a threaded shank portion 29 threadably engaged within a threaded cylinder secured within the edge post 20. The guide rod 23 is an enlarged disc-shaped end 31 which is receivable in the undercut channel on opposed elongated side edges of the guide slot 18.

Referring now to Fire 7 there is shown the construction of the intermediate guide member 22. This lock member comprises a cylinder 32 having a circular neck portion 33 of reduced diameter, and defining an annular disc shaped end 34 which is also receivable in the undercut channel on opposed elongated side edges of the guide slot 18. A retractable spring-loaded pin 35 moves out of the outer edge of the annular disc 34 to engage into a hole 36 (see FIG. 2) provided in the guide slot 18 and spaced under the entrance opening 27 to provide one lock point of the displaceable gate when in its position of use. The pin 35 is provided with a flange 37 which is spring-biased by spring 38 outwardly of the outer edge 20' of the edge post 20. The lock pin 35 is retracted by a finger engaging knob 39 disposed on the inner face 20'' of the edge post 20.

Figure 6:
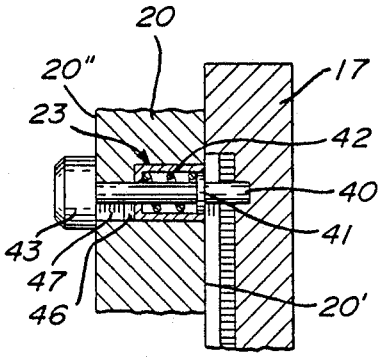
FIG. 6 is a fragmented section view showing the construction of the top lock member.

Referring now to FIG. 6 there is shown the construction of the upper lock member 23, and it merely consists of a spring-biased lock pin 40 also having a flange wall 41 against which a spring 42 applies pressure to bias the pin outwardly of the edge 20'. A finger engaging head or knob 43 also permits the pin 40 to be retracted inwardly within the edge 20' and out of engagement with its engaging bore or hole 44 (see FIG. 2). Accordingly, the displaceable side gate is locked at two spaced apart points, on each side thereof, namely holes 44 and 36, to rigidly secure the displaceable gate when in its position of use and to prevent rattling thereof by a child holding the gate and standing on the mattress 15 and shaking it. Both the lower and intermediate guide members 21 and 22 are the only two members in sliding engagement within the undercut portion of the slot 18, and these are spaced a predetermined distance whereby the gate may be displaceable from the straight channel section along the vertical side posts or members 17 and 17' to the horizontal transverse lower guide channel section 18'. As shown in FIG. 2 both these sections communicate with one another through an intermediate arcuate channel section 45.

Figure 7:
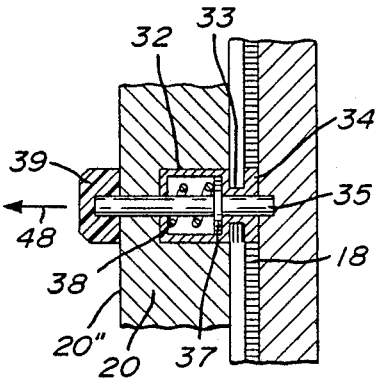
FIG. 7 is a fragmented section view showing the construction of the guide member having the lock element.
Figure 9A:
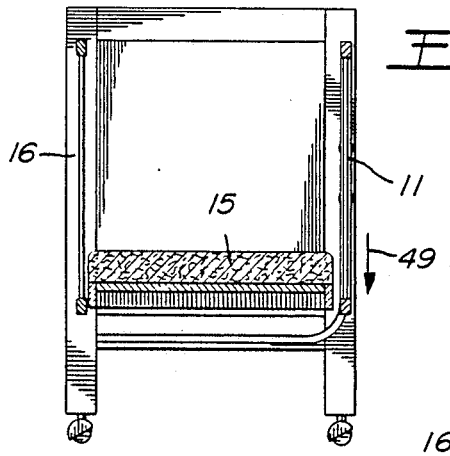
FIG. 9A, 9B and 9C are schematic views illustrating the operation of the displaceable gate of the present invention.
Figure 9B:
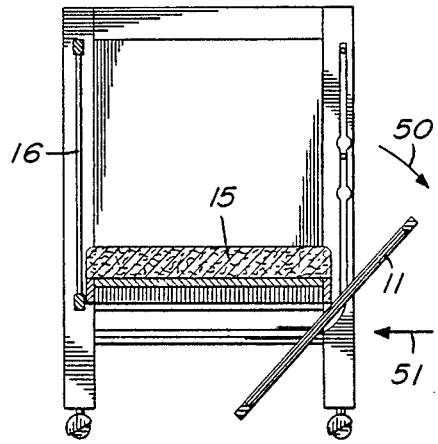
Figure 9C:
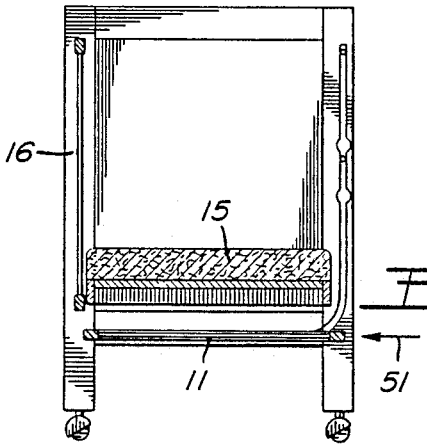

Referring again to FIG. 6 it can be seen that the lock pin 44 is further provided with a retention finger 46 which moves within a slot 47, and when the knob 43 is pulled out, this finger 46 moves out of the inner surface 20'' of the edge post 20 out of its slot 47. By turning the knob 43 the finger 46 will abut against the surface 20'' and retain the pin 40 retracted. With the pin retracted it is now possible for the person to retract the knobs 39 of the intermediate guide member 22 in the direction of arrow 48, as shown in FIG. 7, and to lower the gate in the direction of arrow 49, as shown in FIG. 9A. As soon as the lower guide member 21 reaches the arcuate section 45 of the guide slot, the displaceable gate 11 is pushed down and automatically arcs out in the direction of arrow 50, and is guided inwardly under the mattress in the direction of arrow 51, as shown in FIG. 9B, and by further pushing the gate in the direction of arrow 51 it then assumes its storage position as shown in FIG. 9C. To engage the gate in its position of use the gate is then pulled out from under the mattress while at the same time lifted to its vertical position to reengage the lock members.

Figure 10:
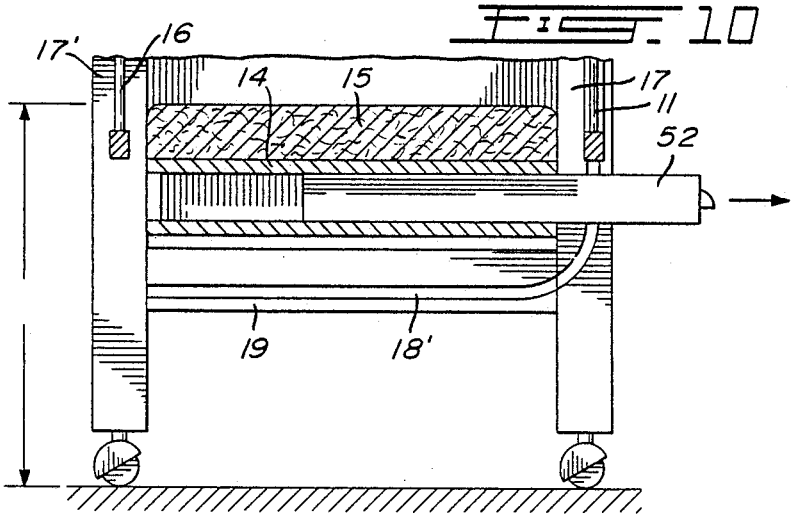
FIG. 10 is a fragmented section view showing a modification of the frame under the mattress.

FIG. 10 shows a modification of the base member of the crib wherein a drawer 52 may be conveniently stored under the mattress support frame 14 and above the cross piece 19 which has been lowered. By lowering the cross piece 19 and the mattress support frame 14, the height of the mattress "h" can be diminished, and accordingly can permit the crib to be constructed lower and an older small child can use the crib as a bed by permitting him to climb onto the mattress 15 from the side edge where the displaceable gate is in its storage position.

FIG. 11 shows a further modification and wherein a guide channel is provided in both opposed vertical side members 17 and 17'. The cross piece 19 is made wider whereby to accommodate two guide channel straight sections 18' positioned side by side. Accordingly, both gates 11 and 16 may be displaceable gates which can be stored under the mattress to convert the crib into an open-sided bed for young children. Also, by making both gates collapsible, full access to the mattress area can be provided from either side of the crib. This may be advantageous in certain use for the crib.

Referring now to FIGS. 12A and 12B there is shown another alternative construction of the child crib of the present invention having a storable side gate. As herein shown, the side gate 60 is removably secured between the vertical side frame 17 of the crib 10 by detachable connecting means 61. These detachable connecting means 61 may be in the form of screw connectors or lock members, such as the lock members 23 shown in FIG. 3. There are preferably two of these connectors on each of the edge posts 62 to provide added safety to prevent disengagement thereof by a child positioned on the mattress 15 within the crib. Thus, the side gate 60 is detachably connected between opposed ones of the vertical side edge frames 17 of the head and foot frames.

As can be seen, a support means 63 in the form of an angled member having a horizontal flange 64 is connected under the mattress 15 and spaced downwardly therefrom whereby to support the gate 60 thereon under the mattress. As shown in FIG. 12B, the gate 60 is positioned on opposed ones of these flanges 64 and simply slid thereon whereby to be supported under the mattress in a storage position. Of course, opposed ones of the side gates may be removably secured between vertical side edges and stored under the mattress on two pairs of these flange 65 to the crosspieces 19 between the vertical posts 17 and 17', or simply between the posts 17 and 17'.

It is pointed out that with the construction of the displaceable side gate of the present invention it is not possible for a child to accidentally unlock the gate due to the fact that the spring tension is too strong for a child to pull. Also, there are too many lock points, and the edge post of the gate is connected closely spaced or flush to the side edges of the head and foot frames concealing the slot. Also, with the slot undercuts, it is necessary to lift the gate to disconnect it from the head and foot frames. Although the crib described herein is provided with wooden edge posts, metal posts with channel members may also be constructed.

It is within the ambit of the present invention to cover any obvious modifications of the preferred embodiment described herein, provided such modifications fall within the scope of the appended claims.

I claim:

1. A child crib comprising a head and a foot frame, a mattress supported elevated between said frames, said frames each having opposed vertical side edges, a gate secured to one side of said mattress between a common one of said vertical side edges of said head and foot frames and extending above said mattress, the other common ones of said vertical side edges each having a first straight elongated guide channel means section extending in a predetermined length thereof and communicating at a lower end thereof with a further guide channel means section extending under said mattress, and a displaceable gate having engaging means in opposed side edges thereof for guided engagement with said elongated guide channel means to displace said displaceable gate from a position of use between the said other common ones of said vertical side edges of said frames to a storage position under said mattress, said engaging means of said gate having at least two spaced apart guide members for sliding engagement with said guide channel means, at least one of said guide members having a lock means to secure said displaceable gate in said position of use.

2. A child crib as claimed in claim 1 wherein said lock means is a lock element securable in a lock cavity associated with said guide channel means.

3. A child crib as claimed in claim 1 wherein said elongated guide channel means is a longitudinal guide slot formed in each said head and foot frame and extending in a cross piece bridging opposed vertical side edge members of each said head and foot frames.

4. A child crib as claimed in claim 3 wherein said guide slot is provided with an undercut channel on opposed elongated side edges thereof for slidingly retaining therein a shoulder portion of said guide members, and two spaced apart entrance openings for inserting said guide members in said guide slot, said entrance openings being spaced apart the same distance as said guide members.

5. A child crib as claimed in claim 4 wherein said lock element is a retractable spring-loaded pin extending from a bottom face of said at least one guide member, said lock cavity being a hole in a bottom wall of said guide slot for receiving said pin therein, said hole being spaced downwardly of an associated one of said entrance openings.

6. A child crib as claimed in claim 5 wherein there is further provided a lock member disposed adjacent a top end portion of said opposed side edges of said displaceable gate for releasable engagement with a respective one of said side edge members of said other common ones of said vertical side edge members.

7. A child crib as claimed in claim 6 wherein said lock member is a spring-biased lock pin disposed adjacent a top end of a side edge post of said displaceable gate, said lock pin extending out of an outer edge of said post, and a retractable finger engaging head secured to said lock pin and disposed adjacent an inner edge of said post for retracting said lock pin entirely within said post.

8. A child crib as claimed in claim 7 wherein said lock pin is receivable within a bore in a top end of said guide slot.

9. A child crib as claimed in claim 5 wherein a one of said guide members is a guide rod extending outwardly from each opposed outer edges of said displaceable gate, said guide rod having an enlarged disc-shaped end receivable in said undercut channel on opposed elongated side edges of said guide slot.

10. A child crib as claimed in claim 9 wherein said lock element of said at least one guide member is a retractable spring-loaded pin extending outwardly from a guide cylinder which extends outwardly from said outer edge of said displaceable gate, said guide cylinder having an annular disc-shaped end receivable in said undercut channel on opposed elongated side edges of said guide slot.

11. A child crib as claimed in claim 3 wherein said first elongated guide slot section communicates with said further guide slot section through an intermediate arcuate guide slot section, said further guide slot section being disposed horizontally under said mattress at substantially right angles to said first guide slot section.

12. A child crib as claimed in claim 11 wherein a lower one of said at least two spaced apart guide members is positioned a predetermined distance from a lower edge of said displaceable gate not to interfere with a floor surface on which said crib is disposed, said predetermined distance being less than the distance from said floor surface to said guide slot under said mattress.

13. A child crib as claimed in claim 6 wherein said at least two spaced apart guide members and said lock member are secured in outer edges of opposed side edge posts of said displaceable gate and retain said side edge posts closely spaced to respective ones of said vertical side edge members of said head and foot frames.

14. In a child crib having a head and a foot frame, a mattress supported elevated between said head and foot frames, said head and foot frames each having opposed vertical side edges, and a gate secured to each side of said mattress between common ones of said vertical side edges, the improvement comprising guide channel means disposed in said vertical side edges and under said mattress for guiding displacement of at least one of said gates from a position of use between said vertical side edges to a storage position under said mattress, said at least one of said gates having lock means in opposed side edges thereof and comprised of at least two spaced apart guide members for sliding engagement with said guide channel means, at least one of said guide members having a lock means to secure said displaceable gate in said position of use.

15. A child crib as claimed in claim 14 wherein guide channel means are disposed in each said vertical side edges and in one or more cross pieces under said mattress for guiding displacement of both said gates from said position of use to said storage position.

16. A child crib comprising a head and a foot frame, a mattress supported elevated between said frames, said frames each having opposed vertical side edges, a gate secured between opposed sides of said mattress between a common one of said vertical side edges of said head and foot frames and extending above said mattress, at least one of said gates being removably secured between said vertical side edges by detachable connecting means, and support means under said mattress for supporting said removable gate in a storage position when disengaged from its associated vertical side edges, said at least one of said gates having lock means in opposed side edges thereof and comprised of at least two spaced apart guide members for sliding engagement with said guide channel means, at least one of said guide members having a lock means to secure said displaceable gate in said position of use.

17. A child crib as claimed in claim 16 wherein said support means is constituted by a flange member supported under said mattress and spaced therefrom and extending between both vertical side edges of said head and foot frames, said removable gate being supported between said flange members.

* * * * *